US005192654A

United States Patent [19]

Hioki et al.

[11] Patent Number: 5,192,654

[45] Date of Patent: Mar. 9, 1993

[54] SILVER HALIDE PHOTOGRAPHIC EMULSIONS

[75] Inventors: Takanori Hioki; Haruo Takei, both of Kanagawa, Japan

[73] Assignee: Fuji Photo Film Co., Ltd., Kanagawa, Japan

[21] Appl. No.: 801,628

[22] Filed: Dec. 4, 1991

Related U.S. Application Data

[63] Continuation of Ser. No. 507,539, Apr. 11, 1990, abandoned.

[30] Foreign Application Priority Data

Apr. 11, 1989 [JP] Japan ..... 1-91241

[51] Int. Cl.[5] ..... G03C 1/28

[52] U.S. Cl. ..... 430/576; 430/570; 430/572; 430/600

[58] Field of Search ..... 430/600, 570, 572, 573, 430/574, 576

[56] References Cited

U.S. PATENT DOCUMENTS 3,893,862 7/1975 Munshi et al. ..... 430/600

FOREIGN PATENT DOCUMENTS 0297804 1/1989 European Pat. Off. .

*Primary Examiner*—Roland Martin

*Assistant Examiner*—Janis L. Dote

*Attorney, Agent, or Firm*—Sughrue, Mion, Zinn, Macpeak & Seas

[57] ABSTRACT

A silver halide photographic emulsion including a spectrally sensitizing dye and at least one compound represented by general formula [I] or general formula [II] are disclosed.

General Formula [I]

General Formula [II]

wherein $R_1$, $R_2$, $R_3$, $R_4$, $R_4'$, $R_5$, $R_5'$, $R_6$, $R_7$, $R_8$, $R_9$, $R_{10}$, $R_{11}$ and $R_{12}$ represent hydrogen atoms or univalent organic residual groups.

4 Claims, No Drawings

SILVER HALIDE PHOTOGRAPHIC EMULSIONS

This is a continuation of application Ser. No. 07/507,539, filed Apr. 11, 1990, now abandoned.

FIELD OF THE INVENTION

This invention concerns spectrally sensitized silver halide photographic emulsions, and more precisely it concerns an improvement in respect of the loss of speed which is caused by sensitizing dyes.

BACKGROUND OF THE INVENTION

Spectral sensitization techniques are very important, indeed indispensable, in the manufacture of photosensitive materials which have high photographic speeds and excellent color reproduction characteristics. Spectral sensitizing agents have the effect of absorbing long wavelength light which is essentially unabsorbed by silver halide photographic emulsions in practice and transmitting the energy of the light which has been absorbed to the silver halide. Hence, increasing the amount of light captured by the spectral sensitizing agents is useful for increasing photographic speed. Consequently, attempts have been made to increase the amount of light which is captured by increasing the amount of spectral sensitizing agent which is added to the silver halide emulsion. However, if more than an optimum amount of a spectral sensitizing agent is added to a silver halide emulsion it results in a pronounced loss of photographic speed. This is known generally as dye desensitization, and it is a phenomena in which desensitization occurs in the photosensitive region which the silver halide intrinsically processes, wherein essentially no light is absorbed by the sensitizing dye. In those cases where dye desensitization occurs to a substantial degree, there is inevitably an overall loss of photographic speed even though a spectral sensitizing effect is present. In other words, if dye desensitization is reduced, the speed in the region in which light is absorbed (which is to say the spectrally sensitized speed) due to the sensitizing dye is increased by the same amount. Hence, improvement in respect of dye desensitization is a major theme in spectral sensitization technology. Furthermore, in general terms, dye desensitization increases as the photosensitive region of the sensitizing dyes shifts to longer wavelengths. This fact has been described by C. E. K. Mees in *The Theory of the Photographic Process*, pages 1067–1069 (Published by Macmillan, 1942).

Known methods of reducing dye desensitization and increasing photographic speed have been disclosed in JP-A No. 47-28916, JP-A No. 49-46738, JP-A No. 54-118236 and U.S. Pat. No. 4,011,083. (The term "JP-A" as used herein signifies an "unexamined published Japanese patent application".) However, the sensitizing dyes which can be used in the aforementioned techniques are limited and the effect obtained is still unsatisfactory. At the present time, the most effective known means for the amelioration of dye desensitization involves the conjoint use of the pyrimidine derivatives or triazine derivatives disclosed, for example, in JP-B No. 45-22189, JP-A No. 54-18726, JP-A No. 52-4822, JP-A No. 52-151026 and U.S. Pat. No. 2,945,762, and substituted bis-aminostilbene compounds. (The term "JP-B" as used herein signifies an "examined Japanese patent publication".) However, the aforementioned compounds are effective only in the case of so-called M-band sensitizing type dyes which have a gently sloping sensitizing peak, such as dicarbocyanine dyes, tricarbocyanine dyes, rhodacyanine dyes and merocyanine dyes for example, and dyes which have a sensitizing peak at a comparatively long wavelength.

The fact that sensitization can be achieved in the infrared region with combinations of specified tricarbocyanine dyes and ascorbic acid has been disclosed in U.S. Pat. No. 3,695,888, the fact that the minus blue speed can be raised by the conjoint use of specified complex merocyanine dyes and ascorbic acid has been disclosed in British Patent No. 1,255,084, the fact that an increase in speed can be attained with the conjoint use of specified complex cyanine dyes and ascorbic acid has been disclosed in British Patent No. 1,064,193, and the conjoint use of super-sensitizing agents such as ascorbic acid with desensitizing nuclei containing cyanine dyes has been disclosed in U.S. Pat. No. 3,809,561.

However, in none of the above mentioned conventional techniques is the sensitizing effect of the dye really satisfactory.

SUMMARY OF THE INVENTION

The first aim of the invention is to provide silver halide photographic emulsions of which the photographic speed has been raised by the amelioration of dye desensitization. The second aim of the invention is to provide silver halide photographic emulsions which have a high storage stability.

The aforementioned aims of the invention have been realized by the inclusion of at least one type of compound which can be represented by general formula [I] or general formula [II] in spectrally sensitized silver halide photographic emulsions.

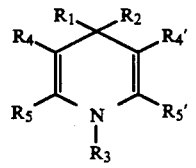

General Formula [I]

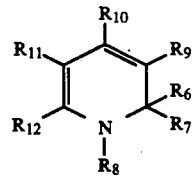

General Formula [II]

In these formulae, $R_1$, $R_2$, $R_3$, $R_4$, $R_4'$, $R_5$, $R_5'$, $R_6$, $R_7$, $R_8$, $R_9$, $R_{10}$, $R_{11}$ and $R_{12}$ represent hydrogen atoms or univalent organic residual groups.

$R_1$, $R_2$, $R_3$, $R_6$, $R_7$ and $R_8$ preferably represent hydrogen atoms, alkyl groups, aryl groups or heterocyclic groups.

$R_4$ and $R_4'$ preferably represent hydrogen atoms, cyano groups, alkoxycarbonyl groups, carboxy groups, carbamoyl groups or acyl groups. However, $R_4$ and $R_4'$ cannot both be hydrogen atoms at the same time.

$R_5$ and $R_5'$ preferably represent hydrogen atoms, alkyl groups or aryl groups.

At least one of $R_9$, $R_{10}$, $R_{11}$ and $R_{12}$ preferably represents a cyan group, an alkoxycarbonyl group, a carboxyl group, a carbamoyl group or an acyl group, and the others represent hydrogen atoms, alkyl groups or aryl groups.

Cyanine dyes and merocyanine dyes are preferred as the spectrally sensitizing dyes which are used in the invention, and complex cyanine dyes can also be used. Moreover, the preferred dyes can be represented by the general formulae [III] and [IV] indicated below.

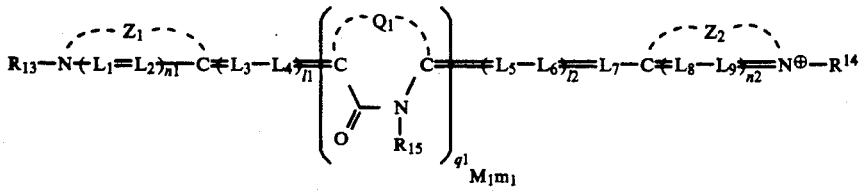

General Formula [III]

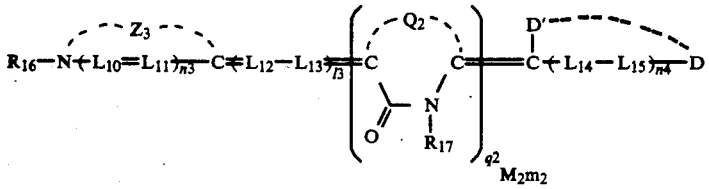

General Formula [IV]

In these formulae, $R_{13}$, $R_{14}$ and $R_{16}$ represent alkyl groups. $R_{15}$ and $R_{17}$ represent hydrogen alkyl groups, aryl groups or heterocyclic groups.

$Z_1$, $Z_2$ and $Z_3$ represent groups of atoms which are required to form five or six membered nitrogen containing heterocyclic rings.

$Q_1$ and $Q_2$ represent groups of atoms which are required to form five or six membered nitrogen containing heterocyclic rings.

D and D' represent groups of atoms which are required to form acidic nuclei, and these may be noncyclic or cyclic.

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$ and $L_{15}$ represent methine groups.

Moreover, $n_1$, $n_2$, $n_3$ and $n_4$ are 0 or 1.

Moreover, $l_1$, $l_2$ and $l_3$ represent 0, 1, 2 or 3.

Moreover, $q_1$ and $q_2$ represent 0 or 1.

$M_1$ and $M_2$ represent charge balancing counter ions, and $m_1$ and $m_2$ are the numbers of value at least zero which are required to balance the charge.

DETAILED DESCRIPTION OF THE INVENTION

General formulae [I], [II], [III] and [IV] are described in detail below.

$R_1$, $R_2$, $R_3$, $R_6$, $R_7$ and $R_8$ are preferably hydrogen atoms, alkyl groups (for example, methyl, ethyl), aryl groups (for example, phenyl), or heterocyclic groups (for example, 2-pyridyl). Most desirably, they are hydrogen atoms.

$R_4$ and $R_4'$ are preferably hydrogen atoms, cyano groups, alkoxycarbonyl groups (for example, ethoxycarbonyl), carboxyl groups, carbamoyl groups (for example, carbamoyl, N-phenylaminocarbonyl, N,N'-dimethylaminocarbonyl) or acyl groups (for example, acetyl). Most desirably, they are alkoxycarbonyl groups.

$R_5$ and $R_5'$ are preferably hydrogen atoms, alkyl groups (for example, methyl) or aryl groups (for example, phenyl, m-nitrophenyl, m-aminophenyl).

Most desirably, they are methyl groups.

At least one of $R_9$, $R_{10}$, $R_{11}$ and $R_{12}$ is preferably a cyano group, alkoxycarbonyl group (for example, ethoxycarbonyl), carboxyl group, carbamoyl group (for example, carbamoyl, N,N'-dimethylaminocarbamoyl) or acyl group (for example, acetyl, propionyl). The cyano group and the alkoxycarbonyl groups are the most desirable. The others are preferably hydrogen atoms, alkyl groups (for example, methyl), or aryl groups (for example, phenyl). They are most desirably hydrogen atoms or aryl groups.

$R_{13}$, $R_{14}$ and $R_{16}$ are preferably unsubstituted alkyl groups which have not more than 18 carbon atoms (for example, methyl, ethyl, propyl, butyl, pentyl, octyl, decyl, dodecyl, octadecyl) or substituted alkyl groups which have not more than 18 carbon atoms which are substituted with, for example, carboxyl groups, sulfo groups, cyano groups, halogen atoms (for example, fluorine, chlorine, bromine), hydroxyl groups, alkoxycarbonyl groups which have not more than 8 carbon atoms (for example, methoxycarbonyl, ethoxycarbonyl, phenoxycarbonyl, benzyloxycarbonyl), alkoxy groups which have not more than 8 carbon atoms (for example, methoxy, ethoxy, benzyloxy, phenethyloxy), aryloxy groups which have not more than 10 carbon atoms (for example, phenoxy, p-tolyloxy), acyloxy groups which have not more than 3 carbon atoms (for example, acetoxy, propionyloxy), acyl groups which have not more than 8 carbon atoms (for example, acetyl, propionyl, benzoyl, mesyl), carbamoyl groups (for example, carbamoyl, N,N-dimethylcarbamoyl, morpholinocarbonyl, piperidinocarbonyl), sulfamoyl groups (for example, sulfamoyl, N,N-dimethylsulfamoyl, morpholinosulfonyl, piperidinosulfonyl), and aryl groups which have not more than 10 carbon atoms (for example, phenyl, 4-chlorophenyl, 4-methylphenyl, α-naphthyl).

Most desirably, they are unsubstituted alkyl groups (for example, methyl, ethyl, pentyl), sulfoalkyl groups (for example, 3-sulfopropyl, 4-sulfobutyl, 2-sulfoethyl), or carboxyalkyl groups (for example, 2-carboxyethyl, carboxymethyl).

Furthermore, the alkali metals are especially desirable as the metal atoms which can form salts with $R_{13}$, $R_{14}$ and $R_{16}$, and pyridines and amines are preferred as organic compounds which can form such salts.

$R_{15}$ and $R_{17}$ are preferably hydrogen atoms, alkyl groups which have from 1 to 18, preferably from 1 to 7, and most desirably from 1 to 4, carbon atoms (for example, methyl, ethyl, propyl, isopropyl, butyl, isobutyl, hexyl, octyl, dodecyl, octadecyl), substituted alkyl groups (for example, aralkyl groups (for example, benzyl, 2-phenylethyl), hydroxyalkyl groups (for example, 2-hydroxyethyl, 3-hydroxypropyl), carboxyalkyl groups (for example, 2-carboxyethyl, 3-carboxypropyl, 4-carboxybutyl, carboxymethyl), alkoxyalkyl groups (for example, 2-methoxyethyl, 2-(2-methoxyethoxy)ethyl), sulfoalkyl groups (for example, 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), sulfatoalkyl groups (for example 3-sulfatopropyl, 4-sulfatobutyl), heterocyclic group substituted alkyl groups (for example 2-(pyrrolidin-2-one-1-yl)ethyl, tetrahydrofurfuryl, 2-morpholinoethyl), 2-acetoxyethyl groups, carbomethoxymethyl groups, 2-methanesulfonylaminoethyl groups}, allyl groups, aryl groups (for example, phenyl, 2-naphthyl), substituted aryl groups (for example, 4-carboxyphenyl, 4-sulfophenyl, 3-chlorophenyl, 3-methylphenyl), or heterocyclic groups (for example, 2-pyridyl, 2-thiazolyl).

Most desirably, they are unsubstituted alkyl groups (for example, methyl, ethyl), carboxyalkyl groups (for example, carboxymethyl, 2-carboxyethyl), or hydroxyalkyl groups (for example, 2-hydroxyethyl).

The nuclei formed by $Z_1$, $Z_2$ and $Z_3$ are preferably thiazole nuclei (thiazole nuclei (for example, thiazole, 4-methylthiazole, 4-phenylthiazole, 4,5-dimethylthiazole, 4,5-diphenylthiazole), benzothiazole nuclei (for example, benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydrobenzothiazole, 4-phenylbenzothiazole), naphthothiazole nuclei (for example, naphtho[2,1-d]-thiazole, naphtho[1,2-d]thiazole, naphtho[2,3-d]thiazole, 5-methoxynaphtho[1,2-d]thiazole, 7-ethoxynaphtho[2,1-d]thiazole, 8methoxynaphtho[2,1-d]thiazole, 5-methoxynaphtho[2,3-d]-thiazole)}, thiazoline nuclei (for example, thiazoline, 4-methylthiazoline, 4-nitrothiazoline), oxazole nuclei {oxazole nuclei (for example, oxazole, 4-methyloxazole, 4-nitrooxazole, 5-methyloxazole, 4-phenyloxazole, 4,5-diphenyloxazole, 4-ethyloxazole), benzoxazole nuclei (for example benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole), naphthoxazole nuclei (for example, naphtho[2,1-d]oxazole, naphtho[1,2-d]oxazole, naphtho[2,3-d]oxazole, 5-nitronaphtho[2,1-d-oxazole)}, oxazoline nuclei (for example, 4,4-dimethyloxazoline), selenazole nuclei {selenazole nuclei (for example, 4-methylselenazole, 4-nitroselenazole, 4phenylselenazole), benzoselenazole nuclei (for example, benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), naphthoselenazole nuclei (for example, naphtho[2,1-d]-selenazole, naphtho[1,2-d]selenazole)}, selenazoline nuclei (for example, selenazoline, 4-methylselenazoline), tellurazole nuclei {tellurazole nuclei (for example, tellurazole, 4-methyltellurazole, 4-phenyltellurazole), benzotellurazole nuclei (for example, benzotellurazole, 5-chlorobenzotellurazole, 5-methylbenzotellurazole, 5,6-dimethylbenzotellurazole, 6-methoxybenzotellurazole), naphthotellurazole nuclei (for example, naphtho[2,1-d]-tellurazole, naphtho[1,2-d]tellurazole)}, tellurazoline nuclei (for example, tellurazoline, 4-methyltellurazoline), 3,3-dialkylindolenine nuclei (for example, 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, 3,3-dimethyl-5-chloroindolenine), imidazole nuclei {imidazole nuclei (for example, 1-alkylimidazole, 1-alkyl-4-phenylimidazole, 1-arylimidazole), benzimidazole nuclei (for example, 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole), naphthimidazole nuclei (for example 1-alkylnaphtho[1,2-d]imidazole, 1-arylnaphtho[1,2-d]imidazole) (the alkyl groups referred to above have from 1 to 8 carbon atoms, being preferably unsubstituted alkyl groups (for example, methyl, ethyl, propyl, iso-propyl, butyl) or hydroxyalkyl groups (for example 2-hydroxyethyl, 3-hydroxypropyl), and of these the methyl group and the ethyl group are especially desirable, and the aforementioned aryl groups are phenyl groups, halogen (for example, chloro) substituted phenyl groups, alkyl (for example methyl) substituted phenyl groups or alkoxy (for example methoxy) substituted phenyl groups)}, pyridine nuclei (for example, 2-pyridine, 4-pyridine, 5-methyl-2-pyridine, 3-methyl-4-pyridine), quinoline nuclei {quinoline nuclei (for example 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline), isoquinoline nuclei (for example, 6-nitro-1-isoquinoline, 3,4-dihydro-1-isoquinoline, 6-nitro-3-isoquinoline)}, imidazo[4,5-b]quinoxazoline nuclei (for example, 1,3-diethylimidazo[4,5-b]quinoxaline, 6-chloro-1,3diallylimidazo[4,5-b]quinoxaline), oxadiazole nuclei, thiadiazole nuclei, tetrazole nuclei or pyrimidine nuclei.

Benzothiazole nuclei, naphthothiazole nuclei, benzoxazole nuclei, naphthoxazole nuclei and benzimidazole nuclei are especially desirable.

D and D' represent groups of atoms which are required to form acidic nuclei, and these may take the form of any of the acidic nuclei generally found in merocyanine dyes. In the preferred form, D is a cyano group, a sulfo group or a carbonyl group, and D' is the remainder of the group of atoms required to form the acidic nucleus.

In those cases where the acidic nucleus is noncyclic, which is to say when D and D' are individual groups, the termination of the methine bond is a group such as malononitrile, alklysulfonylacetonitrile, cyanomethylbenzofuranylketone or aminomethylphenyl ketone.

D and D' can together form a five or six membered heterocyclic ring comprised of carbon, nitrogen and chalcogen (typically oxygen, sulfur, selenium and tellurium) atoms. D and D' together preferably form a nucleus such as those indicated below.

2-pyrazolin-5-one, pyrazolin-3,5-dione, imidazolin-5-one, hydantoin, 2- or 4-thiohydantoin, 2-imino-oxazolidin-4-one, 2-oxazolin-5-one, 2-thio-oxazolidin-2,4-dione, isooxazolin-5-one, 2-thiazolin-4-one, thiazolidin-4-one, thiazolidin-2,4-dione, rhodanine, thiazolidin-2,4-thione, iso-rhodanine, indan-1,3-dione, thiophen-3-one, thiophen-3-one-1,1-dioxide, indolin-2-one, indolin-3-one, indazolin-3-one, 2-oxoindazolinium, 3-oxoindazolinium, 5,7-dioxo-6,7-dihydrothiazolo[3,2-a]pyridine, cyclohexan-1,3-dione, 3,4-dihydroisoquinolin-4-one, 1,3-dioxan-4,6-dione, barbituric acid, 2-thiobarbituric acid, chroman-2,4-dione, indazolin-2-one or pyrido[1,2-a]pyrimidin-1,3-dione nuclei.

The 3-alkylrhodanine nucleus, the 3-alkyl-2-thioxazolidin-2,4-dione nucleus, the 3-alkyl-2-thiohydantoin nucleus and the 3-alkyl-2-thio-oxazolin-2,4-dione nucleus are especially desirable.

The substituent groups which are bound to nitrogen atoms which are included in these nuclei are the same as $R_{15}$ and $R_{17}$.

The five or six membered nitrogen containing heterocyclic rings formed by $Q_1$ and $Q_2$ are rings from which an oxo group or thioxo group has been removed from the appropriate position from the heterocyclic rings which have a ring structure represented by D and D'.

The rhodanine nucleus is especially desirable.

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$ and $L_{15}$ represent methine groups {which may be substituted for example, with substituted or unsubstituted alkyl groups (for example, methyl, ethyl, 2-carboxyethyl), substituted or unsubstituted aryl groups (for example, phenyl, o-carboxyphenyl), halogen atoms (for example, chlorine, bromine), alkoxy groups (for example, methoxy, ethoxy), alkylthio groups (for example, methylthio, ethylthio)}, and they may form rings with other methine groups, or they can form rings with auxochromes.

$M_1m_1$ and $M_2m_2$ are included in the formulae to indicate the presence or absence of anions and cations when it is necessary to neutralize the ionic charge on the dye. Whether or not a certain dye is cationic or anionic, or whether it has a net charge at all, depends on the auxochromes and substituent groups.

The ammonium ion and alkali metal ions are typical cations, while the anions may be inorganic anions or organic anions, for example halogen anions (for example, fluorine ion, chlorine ion, bromine ion, iodine ion), substituted arylsulfonate ions (for example, p-toluenesulfonate ion, p-chlorobenzenesulfonate ion), aryldisulfonate ions (for example, 1,3-benzenedisulfonate ion, 1,5-naphthalenedisulfonate ion, 2,6-naphthalenedisulfonate ion), alkyl sulfate ions (for example, methyl sulfate ion), sulfate ion, thiocyanate ion, perchlorate ion, tetrafluoroborate ion, picrate ion, acetate ion or trifluoromethanesulfonate ion.

The ammonium ion, the sodium ion and the potassium ion are preferred as cations and the iodine ion is preferred as an anion.

Moreover, groups which are adsorbable on silver halide can be introduced into $R_1$, $R_2$, $R_3$, $R_4$, $R_4'$, $R_5$, $R_5'$, $R_6$, $R_7$, $R_8$, $R_9$, $R_{10}$, $R_{11}$ and $R_{12}$ in order to locate the compound represented by general formula [I] or [II] in the vicinity of the silver halide.

For example, the group absorbable on silver halide can be represented by $(L_{16})_r$-Het. Here, $L_{16}$ represents a divalent linking group comprising an atom or group of atoms which includes at least one carbon atom, nitrogen atom or oxygen atom, and Het represents a five, six or seven membered heterocyclic ring which contains at least one nitrogen atom and which may contain hetero atoms other than nitrogen. Moreover, r is 0, 1 or 2. This is described in more detail below.

$L_{16}$ represents a divalent linking group comprising an atom or group of atoms which contains at least one carbon atom, nitrogen atom, sulfur atom or oxygen atom. It is preferably an alkylene group (for example, methylene, ethylene, propylene, butylene, pentylene), arylene group (for example, phenylene, naphthylene), alkenylene group (for example, ethylene, propenylene), sulfonyl group, sulfinyl group, thioether group, ether group, carbonyl group or an

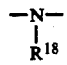

group (where $R^{18}$ represents a hydrogen atom, an alkyl group or an aryl group).

It may also represent a divalent group which has not more than 20 carbon atoms constructed by combination of one or more divalent heterocyclic groups (for example 6-chloro-1,3,5-triazin-2,3-diyl, pyrimidin-2,4-diyl, quinolin-2,3-diyl).

Het represents a compound part which contains a five to seven membered saturated or unsaturated heterocyclic ring which contains at least one nitrogen atom and which can contain other hetero atoms (for example, oxygen, sulfur, selenium, tellurium) as well as the nitrogen atom(s).

Those which have a structure which can be represented by the general formulae [V] -[IX] are preferred.

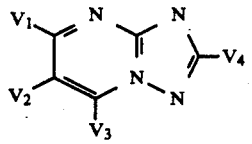

General Formula [V]

In this formula, $V_1$, $V_2$, $V_3$ and $V_4$ represent hydrogen atoms, alkyl groups (for example, methyl, ethyl, propyl, butyl, hydroxyethyl, trifluoromethyl, benzyl, sulfopropyl, diethylaminoethyl, cyanopropyl, adamantyl, p-chlorophenethyl, ethoxyethyl, ethylthioethyl, phenoxyethyl, carbamoylethyl, carboxyethyl, ethoxycarbonylmethyl, acetylaminoethyl), alkenyl groups (for example, allyl, styryl), aryl groups (for example phenyl, naphthyl, p-carboxyphenyl, 3,5-dicarboxyphenyl, m-sulfophenyl, p-acetamidophenyl, 3-caprylamidophenyl, p-sulfamoylphenyl, m-hydroxyphenyl, p-nitrophenyl, 3,5-dichlorophenyl, p-anisyl, o-anisyl, p-cyanophenyl, p-N,-methylureidophenyl, m-fluorophenyl, p-tolyl, m-tolyl), heterocyclic groups (for example, pyridyl, 5-methyl-2-pyridyl, thienyl), halogen atoms (for example, chlorine, bromine, fluorine), mercapto groups, cyano groups, carboxyl groups, sulfo groups, hydroxyl groups, carbamoyl groups, sulfamoyl groups, amino groups, nitro groups, alkoxy groups (for example, methoxy, ethoxy, 2-ethoxyethoxy, 2-phenylethoxy), aryloxy groups (for example, phenoxy, p-methylphenoxy, p-chlorophenoxy), acyl groups (for example, acetyl, benzoyl), acylamino groups (for example, acetylamino, caproylamino), sulfonyl groups (for example, methanesulfonyl, benzenesulfonyl), sulfonamino groups (for example, methanesulfonylamino, benzenesulfonylamino), amino groups (for example, diethylamino, hydroxyamino), alkyl or aryl thio groups (for example, methylthio, carboxyethylthio, sulfobutylthio, phenylthio), alkoxycarbonyl groups (for example, methoxycarbonyl) or aryloxycarbonyl groups (for example phenoxycarbonyl), and these may be further substituted with substituent groups.

Furthermore, at least one of $V^1$, $V^2$, $V^3$ and $V^4$ may represent a divalent linking group $L_{16}$ or a single bond. Moreover, the divalent linking group $L_{16}$ or the single bond may be substituted.

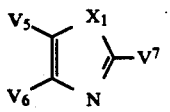

General Formula [VI]

In this formula, $X_1$ represents an oxygen atom, a sulfur atom or N-$R_{19}$. (Here, $R_{19}$ represents a hydrogen atom, an alkyl group, an aryl group or a heterocyclic group.)

$V^5$, $V^6$ and $V^7$ have the same significance as $V^1$–$V^4$ in the aforementioned general formula [V], or they may represent divalent linking groups as described earlier, or single bonds.

Furthermore, $V^5$ and $V^6$ may be bonded together to form a benzo or naphtho condensed ring.

The substituent groups indicated for $V^1$–$V^4$ in the aforementioned general formula [V] and/or linking groups $L_{16}$ (or single bonds) can be substituted on the condensed benzo and naphtho rings and $R_{19}$ (except where this is hydrogen).

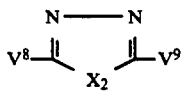

General Formula [VII]

$X_2$ in this formula represents an oxygen atom, a sulfur atom or N-$R_{20}$.

$R_{20}$ has the same significance as $R_{19}$ shown in the aforementioned general formula [VI].

Furthermore, $V^8$ and $V^9$ have the same significance as $V^1$–$V^4$ in the aforementioned general formula [V], or they may represent divalent linking groups $L_{16}$ as described above, or single bonds.

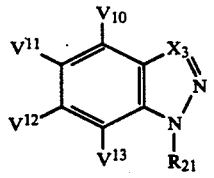

General Formula [VIII]

$X_3$ in this formula represents a nitrogen atom or C-$R_{22}$.

$R_{21}$ and $R_{22}$ have the same significance as $R_{19}$ in the aforementioned general formula [VI], and $V^{10}$, $V^{11}$, $V^{12}$ and $V^{13}$ have the same significance as $V^1$–$V^4$ in the aforementioned general formula [V] or they may be divalent linking groups $L_{16}$ as described earlier, or single bonds.

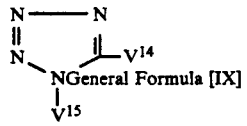

General Formula [IX]

In this formula, $V^{14}$ and $V^{15}$ have the same significance as $V^1$–$V^4$ in the aforementioned general formula [V], or they may be divalent linking groups $L_{16}$ as described earlier, or single bonds. The substituent group with Het is preferably $R_4$, $R_4'$, $R_5$ or $R_5'$.

Actual preferred examples for use in the present invention are indicated below. However, the compounds which can be used in the invention are not limited by these examples. Moreover, "Ph" in the tables signifies $C_6H_5$.

Compounds which can be Represented by General Formula [I] (Showing the Actual Substituent Groups in General Formula [I])

| Compound No. | $R_1$ | $R_2$ | $R_3$ | $R_4$ | $R_4'$ | $R_5$ | $R_5'$ |
|---|---|---|---|---|---|---|---|
| (1) | H | H | H | $CO_2C_2H_5$ | $CO_2C_2H_5$ | $CH_3$ | $CH_3$ |
| (2) | " | " | " | " | " | Ph | Ph |
| (3) | " | " | $CH_3$ | " | " | $CH_3$ | $CH_3$ |
| (4) | " | " | Ph | " | " | " | " |
| (5) | $C_2H_5$ | " | H | " | " | " | " |
| (6) | Ph | " | " | " | " | " | " |
| (7) | H | H | H | CN | CN | " | " |
| (8) | " | " | " | $COCH_3$ | $COCH_3$ | " | " |
| (9) | " | " | $CH_2Ph$ | $CONH_2$ | H | H | H |
| (10) | " | " | " | CN | " | " | " |
| (11) | " | " | " | Cl | " | " | " |
| (12) | " | " | H | $CO_2C_2H_5$ | $COCH_3$ | $CH_3$ | $CH_3$ |
| (13) | " | " | " | CONHPh | $CO_2C_2H_5$ | " | " |
| (14) | " | " | " | " | CN | " | " |
| (15) | " | " | " | $CO_2C_2H_5$ | $CO_2C_2H_5$ | " | Ph |

-continued
| Compounds which can be Represented by General Formula [I] (Showing the Actual Substituent Groups in General Formula [I]) | | | | | | | |
|---|---|---|---|---|---|---|---|
| Compound No. | $R_1$ | $R_2$ | $R_3$ | $R_4$ | $R_4'$ | $R_5$ | $R_5'$ |
| (16) | " | " | " | " | " | " | 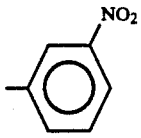 |
| (17) | " | " | " | " | " | " | 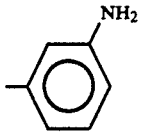 |
| (18) | " | " | " | CN | 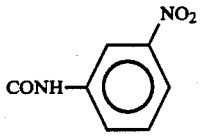 | " | $CH_3$ |
| (19) | " | " | " | " | 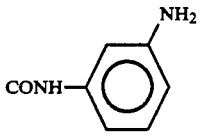 | " | " |
| (20) | $C_2H_5$ | " | Ph | $CO_2C_2H_5$ | $CO_2C_2H_5$ | " | " |
(21)
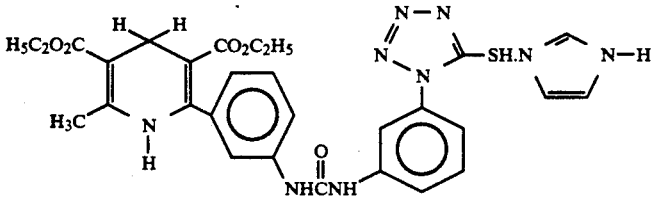
(22)
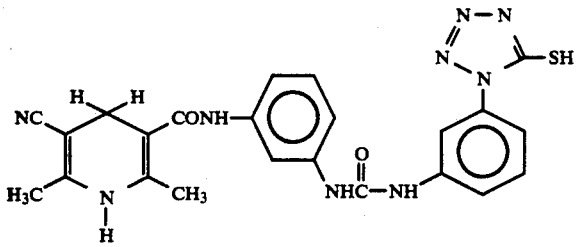
(23)
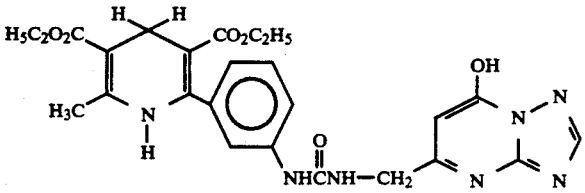
(24)

-continued

| Compound No. | Compounds which can be Represented by General Formula [I] (Showing the Actual Substituent Groups in General Formula [I]) | | | | | | |
|---|---|---|---|---|---|---|---|
| | $R_1$ | $R_2$ | $R_3$ | $R_4$ | $R_4'$ | $R_5$ | $R_5'$ |

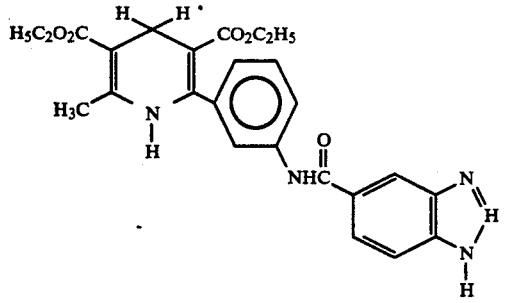

(25)

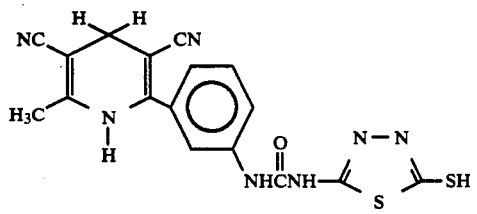

| Compound No | Compounds which can be Represented by General Formula [II] (Showing the Actual Substituent Groups in General Formula [II]) | | | | | | |
|---|---|---|---|---|---|---|---|
| | $R_6$ | $R_7$ | $R_8$ | $R_9$ | $R_{10}$ | $R_{11}$ | $R_{12}$ |
| (26) | H | H | H | CN | H | CN | H |
| (27) | " | " | $CH_3$ | " | " | " | " |
| (28) | " | " | " | $CONH_2$ | " | " | " |
| (29) | " | " | H | $CO_2CH_3$ | " | $CO_2CH_3$ | " |
| (30) | " | " | " | $COCH_3$ | " | $COCH_3$ | " |
| (31) | " | " | $CH_3$ | Ph | " | Ph | " |
| (32) | " | " | $CH_2Ph$ | H | " | $CONH_2$ | " |
| (33) | " | " | $CH_3$ | " | " | $CO_2CH_3$ | " |
| (34) | " | " | H | " | $CO_2CH_3$ | H | " |
| (35) | " | " | $CH_3$ | " | Ph | $-(CH_2)_4-$ | |
| (36) | " | " | H | $NO_2$ | H | H | H |
| (37) | $CH_2Ph$ | " | " | CN | $CH_3$ | CN | " |
| (38) | OH | " | $CH_3$ | CN | CN | CN | " |
| (39) | H | " | H | $CO_2C_2H_5$ | CN | H | " |
| (40) | " | " | " | $COCH_3$ | Ph | " | " |

(41)

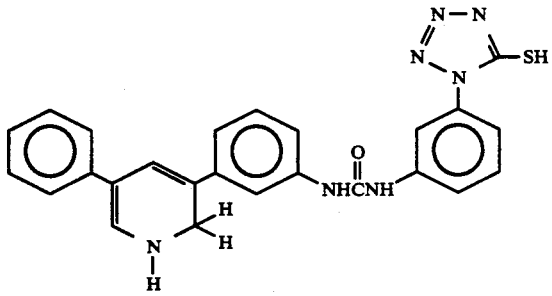

(42)

-continued
| Compounds which can be Represented by General Formula [II] (Showing the Actual Substituent Groups in General Formula [II]) | | | | | | | |
|---|---|---|---|---|---|---|---|
| Compound No | $R_6$ | $R_7$ | $R_8$ | $R_9$ | $R_{10}$ | $R_{11}$ | $R_{12}$ |
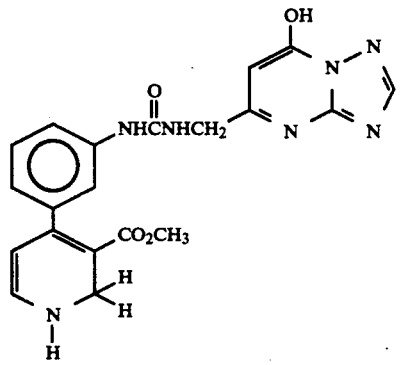
(43)
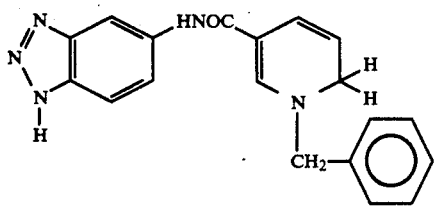
(44)
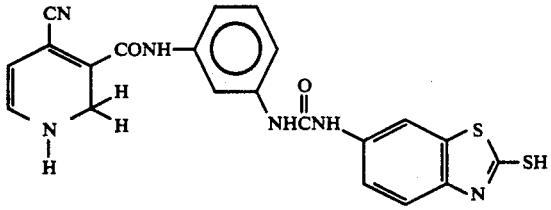
Actual examples of compounds which can be represented by general formula [III] are indicated below.
(III-1)
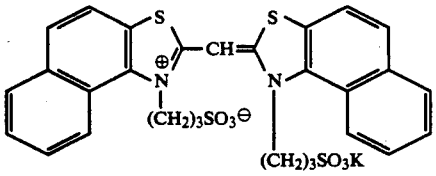
(III-2)
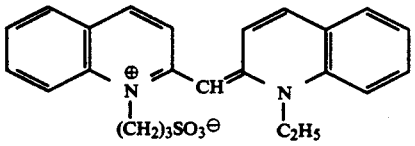
(III-3)
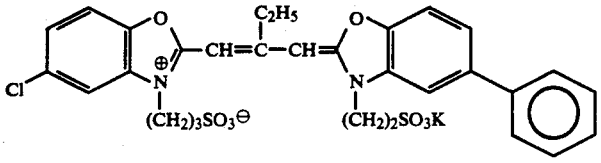

-continued
(III-4)
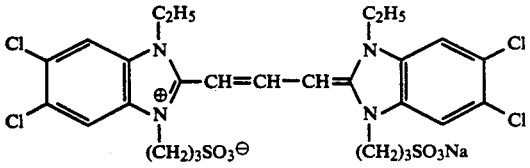
(III-5)
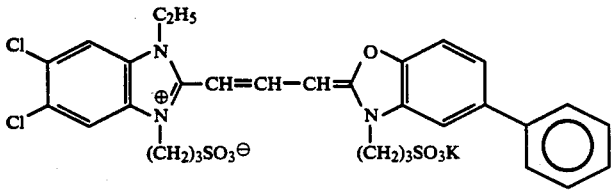
(III-6)
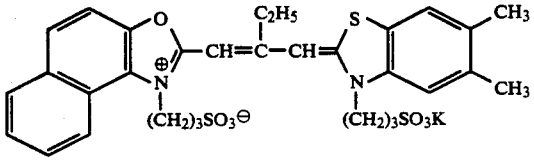
(III-7)
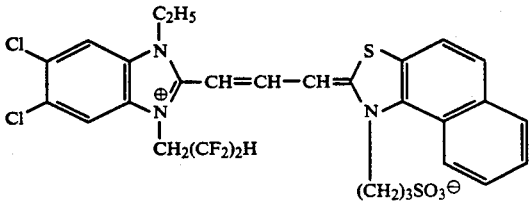
(III-8)
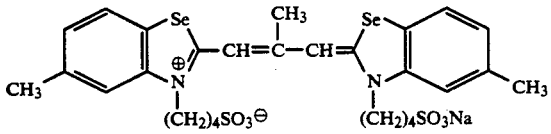
(III-9)
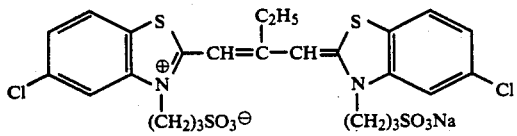
(III-10)
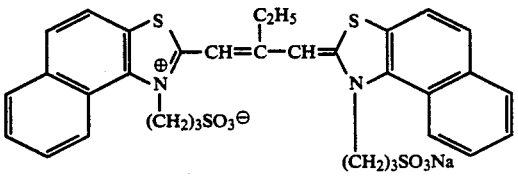
(III-11)
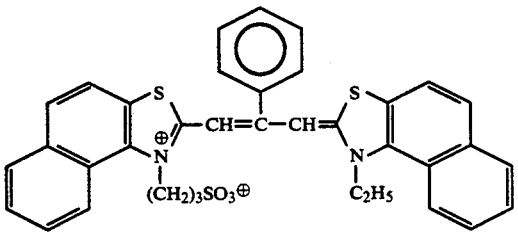

-continued
(III-12)
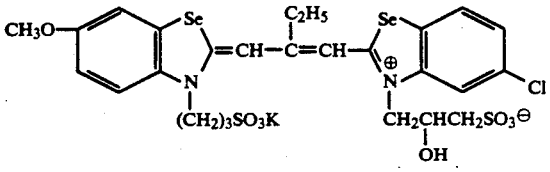
(III-13)
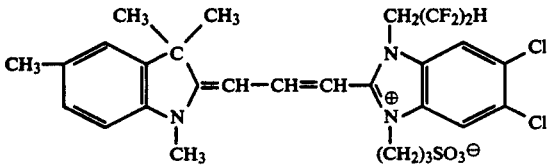
(III-14)
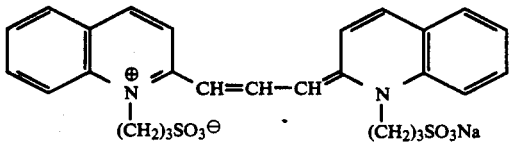
(III-15)
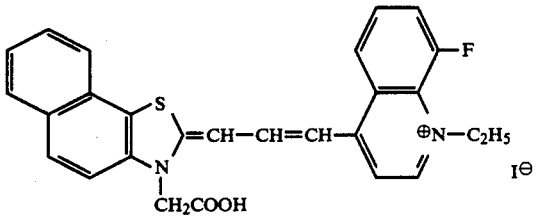
(III-16)
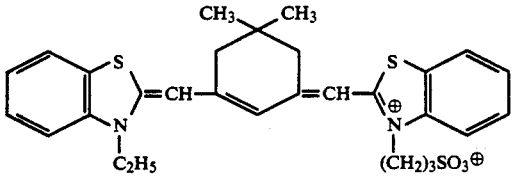
(III-17)
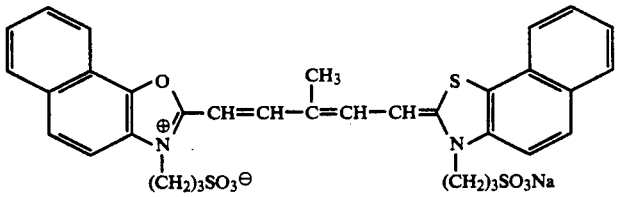
(III-18)
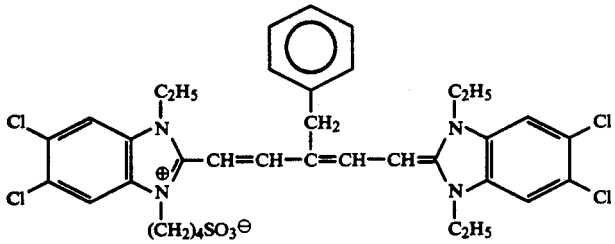
(III-19)
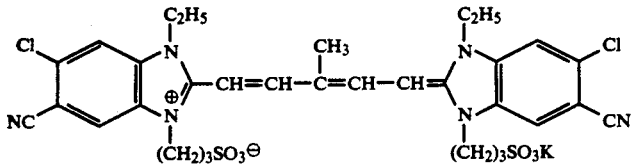

-continued
(III-20)
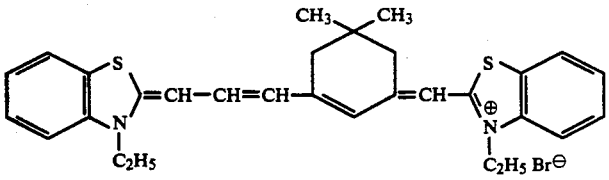
(III-21)
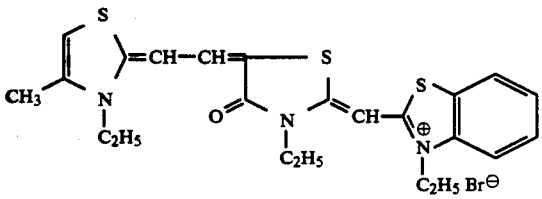
(III-22)
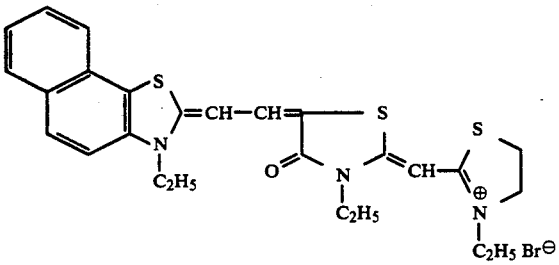
(III-23)
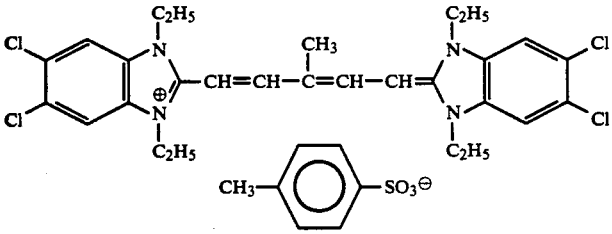
(III-24)
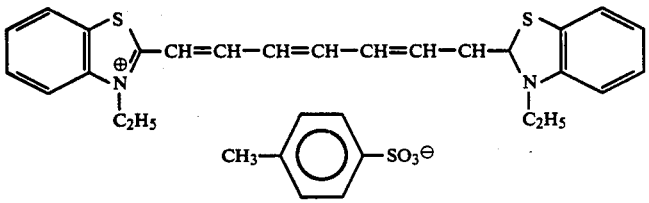
(III-25)
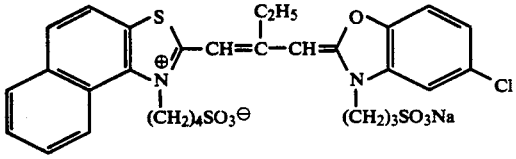
(III-26)
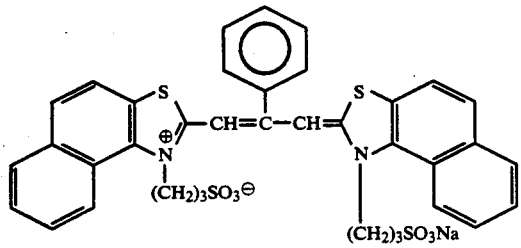

-continued
(III-27)
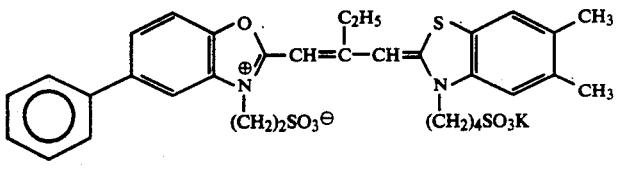
(III-28)
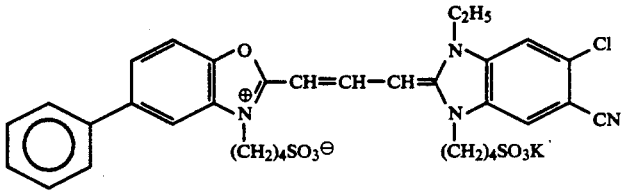
(III-29)
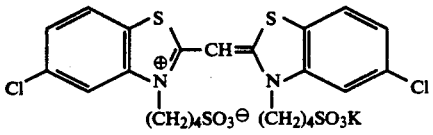
(III-30)
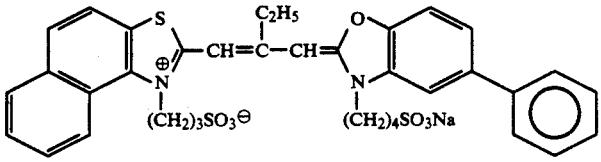
(III-31)
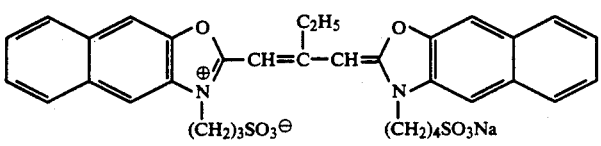
(III-32)
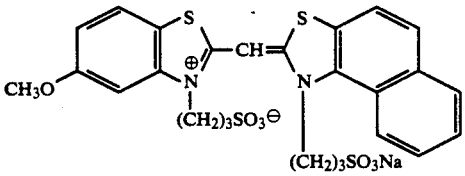
(III-33)
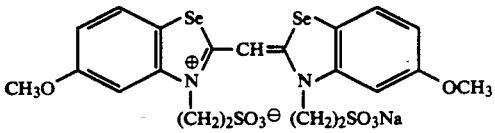
(III-34)
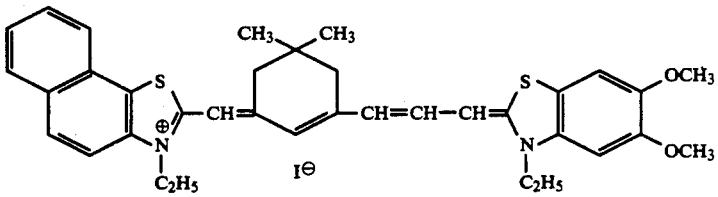
(III-35)
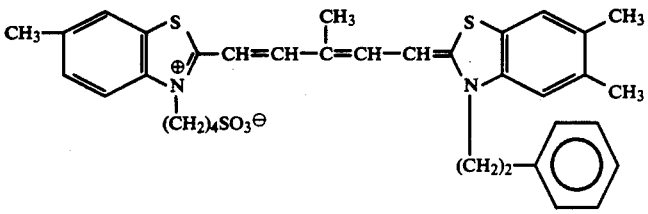

Actual example of compounds which can be represented by general formula [IV] are indicated below.
(IV-1)
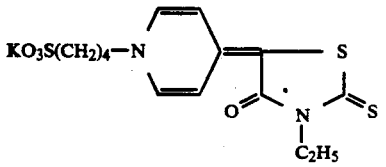
(IV-2)
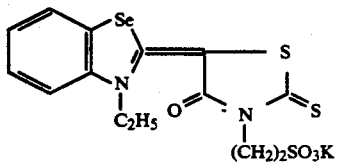
(IV-3)
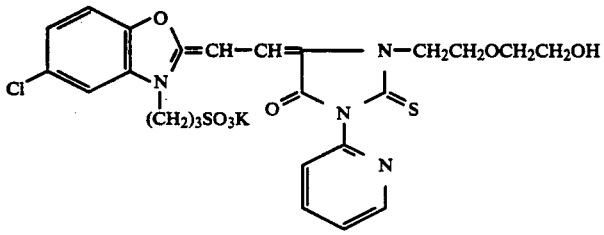
(IV-4)
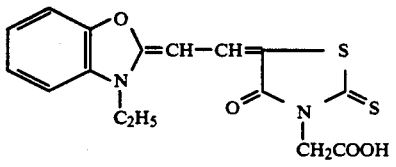
(IV-5)
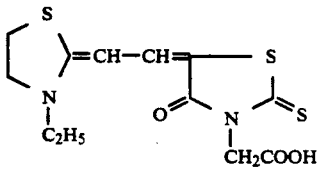
(IV-6)
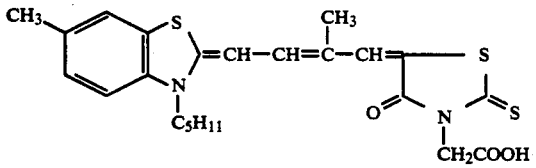
(IV-7)
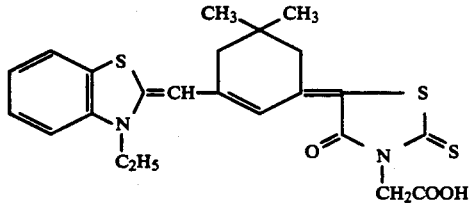
(IV-8)
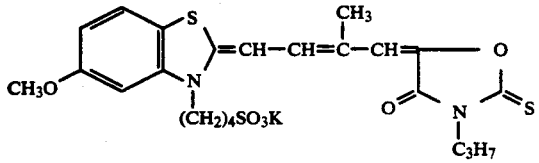

-continued (IV-9)

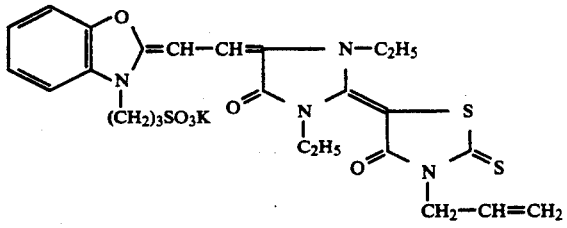

(IV-10)

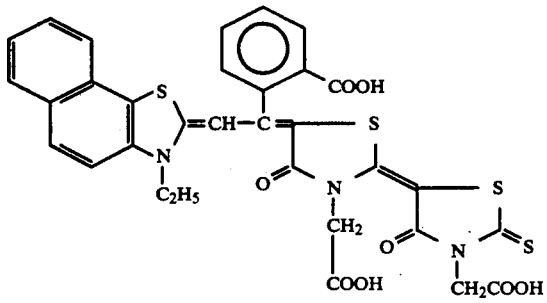

(IV-11)

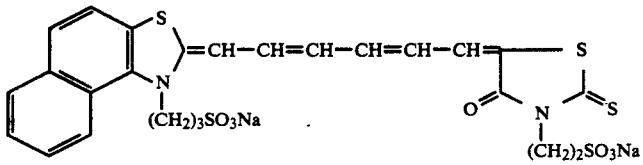

(IV-12)

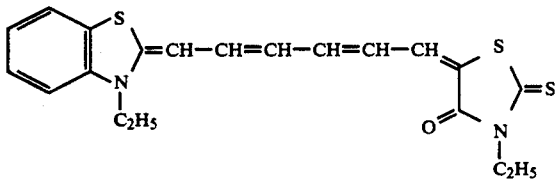

(IV-13)

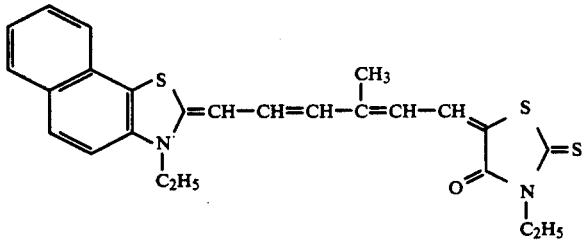

(IV-14)

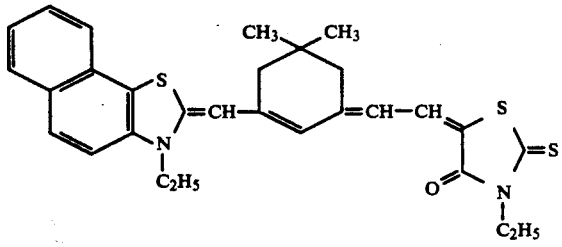

The compounds represented by general formulae [I] and [II] are, with the exception of those which have a specified heterocyclic substituent group, known compounds.

For example, they have been described by Ulli Eisner and Josef Kuthan in Chemical Reviews, Vol. 72, No. 1, pages 1–42 (1972), by Josef Kuthan and A. Kurfirst in *Industry and Engineering Chemistry, Product Research and Development*, Vol. 21, No. 2 (1982), and they can be prepared in the ways indicated in the said literature.

Furthermore, the compounds which have a specified heterocyclic substituent group can be prepared in a way which shows a process for preparing, for example, compound (21) indicated below.

Example of the Preparation of a Dihydropyridine which has a Group which is Adsorbed on Silver Halide Route for the Preparation of Compound (21)

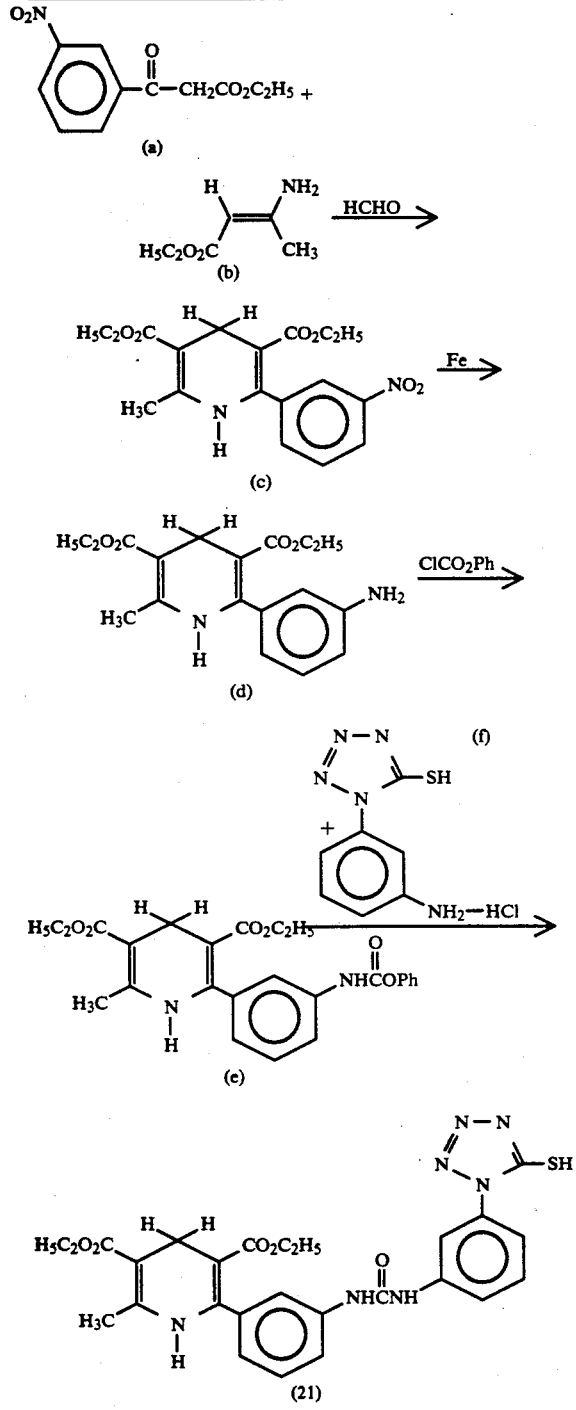

1. The Preparation of (c)

A 37% aqueous solution of formaldehyde (20.5 grams) was added to 60 grams of (a) (mw=237.21, 0.253 mol), 32.7 grams of (b) (mw=129.16, 0.253 mol) and 450 ml of ethanol and the mixture was heated under reflux for 6 hours. After washing with water, the crystals which had precipitated out were separated by suction filtration. The crystals obtained were heated under reflux in ethanol/chloroform solvent to form a solution and, after filtration, about half of the solvent was removed by distillation. The crystals which precipitated out were separated by suction filtration and 30 grams of (c) was obtained. Yield 33% (See European Patent 44262.)

2. The Preparation of (d)

Acetic acid (8.3 grams) was added to 139 grams of reducing iron (mw=55.85, 2.5 mol), 8.84 grams of ammonium chloride (mw=53.49, 0.165 mol), 740 ml of isopropanol and 100 ml of $H_2O$. Moreover, 89.5 grams of (c) (mw=360.37, 0.248 mol) was added over a period of 5 minutes. After heating under reflux for a period of 30 minutes, the mixture was filtered through "sellaite" and cooled. The crystals which precipitated out were separated by suction filtration and (d) was obtained. 28 grams, yield 34%.

3. The Preparation of (e)

A mixture of 4 grams of (d) (mw=330.38, 0.0121 mol), 12 ml of dimethylacetamide and 1 ml of pyridine was agitated at 0° C. and 1.67 ml of phenyl chloroformate was added dropwise. After stirring for 1 hour at 0° C., isopropanol and $H_2O$ were added. The crystals which precipitated out were separated by suction filtration and (e) was obtained. 4.6 grams, yield 84%.

4. The Preparation of (21)

Three grams of (e) (mw=450.49, 0.00666 mol) was added to 30.6 grams of (f) (mw=229.70, 0.0133 mol), 3.6 grams of imidazole (mw=68.08, 0.0533 mol) and 30 ml of acetonitrile and the mixture was heated under reflux for 2 hours under a blanket of nitrogen. After the reaction had been completed, 60 ml of $H_2O$ and 60 ml of ethyl acetate were added and the mixture was extracted. The ethyl acetate layer was left to stand and crystallization occurred gradually. The crystals which precipitated out were separated using suction filtration and (21) was obtained. 2.09 grams, yield 51%, mp. 150°-152° C.

The aforementioned compounds represented by general formula [I] and general formula [II] can be included in a silver halide emulsion of the present invention by direct dispersion in the emulsion, or they may be dissolved in a solvent such as water, methanol or ethanol for example, or in a mixture of such solvents, and the resulting solution can be added to the emulsion. The aforementioned compounds may each be added individually, but the use of a mixed solution of both is preferred for increasing the stability of the solution. The aforementioned compounds can be used by inclusion in any of the processes in the manufacture of the photographic emulsion. Moreover, they can be added before or after the addition of the sensitizing dye. The compounds represented by the general formulae [I] and [II] used in this present invention are included in the silver halide photographic emulsion at rates of from $1\times10^{-6}$ mol to $5\times10^{-2}$ mol, preferably from $1\times10^{-5}$ mol to $2\times10^{-2}$ mol, and most desirably from $1\times10^{-4}$ mol to $1.6\times10^{-2}$ mol, per mol of silver halide.

The sensitizing dyes represented by general formulae [III] and [IV] which are used in the invention are known compounds. For example, compounds represented by general formulae [III] and [IV] have been disclosed, in the specifications of JP-A No. 51-126140, JP-A No. 51-139323, JP-A No. 51-14313, JP-A No. 55-35386, JP-A No. 52-109925, JP-A No.53-135322, West German Patent laid open No. (OLS) 2,158,553, JP-B No. 52-2614 and JP-A No. 47-28916, and by F. M. Hamer in *The Chemistry of Heterocyclic Compounds, Vol. 18, The Cyanine Dyes and Related Compounds*, edited by A. Weissberger, Interscience, New York, 1964, and by D. M. Sturmer in *The Chemistry of Heterocyclic Compounds*, Vol. 30, edited by A. Weissberger and E. C. Taylor, John Wiley, New York, 1977, page 441, and they can be prepared with reference to these publications.

The aforementioned compounds represented by general formulae [III] and [IV] can be included in silver halide emulsions of the present invention by direct dispersion in the emulsion, or they may be dissolved in a solvent such as water, methanol, ethanol, propanol, methylcellosolve, 2,2,3,3-tetrafluoropropanol for example, or in a mixture of such solvents, and the solution can be added to the emulsion. Furthermore, they may be provided as aqueous solutions in the presence of an acid or bases as disclosed, for example, in JP-B No. 44-23389, JP-B No. 44-27555 and JP-B No. 57-22089, or they may be provided as aqueous solutions or dispersions in the presence of surfactants as disclosed, for example, in U.S. Pat. Nos. 3,822,135 and 4,006,025, for addition to the emulsion. Furthermore, they can be dissolved in a solvent such as phenoxyethanol which is essentially immiscible with water and the solution can be dispersed in water or a hydrophilic colloid for addition to the emulsion. They may also be dispersed directly in a hydrophilic colloid as disclosed in JP-A No. 53-102733 and JP-A No. 58-105141 and the dispersion may be added to the emulsion.

The sensitizing dyes used in the present invention may be dissolved using ultrasonic vibrations as disclosed in U.S. Pat. No. 3,485,634. The methods disclosed in U.S. Pat. Nos. 3,482,981, 3,585,195, 3,469,987, 3,425,835 and 3,342,605, British Patent Nos. 1,271,329, 1,038,029 and 1,121,174, and U.S. Pat. Nos. 3,660,101 and 3,658,546 can be used as methods by which the sensitizing dyes of the invention are dissolved or dispersed, and added to the emulsion.

The sensitizing dyes can be introduced during any process during the manufacture of the photographic emulsion, and they can also be introduced at any stage after manufacture until immediately before coating. For example, in the former case they can be introduced during the process in which the silver halide grains are being formed, during the physical ripening process or during the chemical ripening process. For example, they may be added during grain formation, as disclosed in JP-A No. 55-26589.

The sensitizing dyes of general formulae [III] and [IV] used in the present invention are included in the silver halide photographic emulsion at rates of from $5\times10^{-7}$ mol to $5\times10^{-3}$ mol, preferably from $5\times10^{-6}$ mol to $2\times10^{-3}$ mol, and most desirably from $1\times10^{-5}$ mol to $1\times10^{-3}$ mol, per mol of silver halide.

Silver bromide, silver iodobromides, silver iodochlorobromides, silver chlorobromides and silver chloride can be used as the silver halide in the photographic emulsions of the invention.

The silver halide grains may have any crystalline form.

The silver halide emulsions may be such that tabular grains which have a thickness of not more than 0.5 microns, and preferably of less than 0.3 microns, and a diameter of at least 0.6 microns, and of which the average aspect ratio is at least 5 account for at least 50% of the total projected area. Furthermore, they may be mono-disperse emulsions in which at least 95% of all the grains in terms of the number of grains are of a size within ±40% of the average grain size.

The interior and surface layers of the silver halide grains may be comprised of different phases, or the grains may be comprised of a uniform phase. They may be grains of the type with which the latent image is formed principally on the surface (for example, negative type emulsions), or they may be of the type in which the latent image is formed within the grains (for example, internal latent image type emulsions and prefogged direct reversal type emulsions).

The photographic emulsions used in the invention can be prepared using the methods disclosed, for example, by P. Glafkides in *Chimie et Physique Photographique*, published by Paul Montel, 1967, by G. F. Duffin in *Photographic Emulsion Chemistry*, published by Focal Press, 1966, and by V. L. Zelikmann et al. in *Making and Coating Photographic Emulsions*, published by Focal Press, 1964.

That is to say, they can be prepared using acidic methods, neutral methods and ammonia methods for example, and a single sided mixing procedure, a simultaneous mixing procedure, or a combination of such procedures, can be used for reacting the soluble silver salt with the soluble halide.

Methods in which the grains are formed under conditions of excess silver ion (so called reverse mixing methods) can also be used.

The method in which the pAg value of the liquid phase in which the silver halide is being formed is held constant, which is to say the so-called controlled double jet method, can be used as one type of simultaneous mixing method. It is possible to obtain mono-disperse emulsions with a regular crystalline form and an almost uniform grain size when this method is used.

Mixtures of two or more types of silver halide emulsion which have been formed separately can be used.

Ammonia, potassium thiocyanate, ammonium thiocyanate, thioether compounds (for example, those disclosed in U.S. Pat. Nos. 3,271,157, 3,574,628, 3,704,130, 4,297,439 and 4,276,374, thione compounds (for example, those disclosed in JP-A No. 53-144319, JP-A No. 53-82408 and JP-A No. 55-77737), and amine compounds (for example, those disclosed in JP-A No. 54-100717) can be used as silver halide solvents for controlling grain growth during the formation of the silver halide grains.

Cadmium salts, zinc salts, thallium salts, iridium salts or complex salts thereof, rhodium salts or complex salts thereof, and iron salts or complex salts thereof, may be present during the formation of the silver halide grains or during the physical ripening process.

Furthermore, the emulsions in which different metals have been incorporated, disclosed, for example, in U.S. Pat. Nos. 2,592,250, 3,206,313, 3,447,927, 3,761,276 and 3,935,014, can be cited as internal latent image type emulsions which can be used in the invention.

Silver halide emulsions are normally subjected to chemical sensitization. The methods described on pages 675–734 of *Die Grundlagen der Photographishen Prozesse mit Silberhalogeniden*, by H. Frieser, (published by Akademische Verlagsgesellschaft, 1968) can be used, for example, for chemical sensitization.

That is to say, sulfur sensitization methods in which active gelatin or compounds which contain sulfur which can react with silver (for example, thiosulfates, thioureas, mercapto compounds, rhodanines) are used; reduction sensitization methods in which reducing substances (for example, stannous salts, amines, hydrazine derivatives, formamidinesulfinic acid, silane compounds) are used; and precious metal sensitization methods in which precious metal compounds (for example, complex salts of metals of group VIII of the periodic table such as Pt, Ir and Pd, as well as gold) are used can all be used either individually or in combination for this purpose.

Sulfur sensitizing agents, such as allylthiocarbamide, thiourea, sodium thiosulfate or cysteine, precious metal sensitizing agents such as potassium chloroaurate, aurous thiosulfate or potassium chloropalladate, and reduction sensitizing agents such as tin chloride, phenyl hydrazine or reductone, for example, may be included as actual examples of chemical sensitizing agents. Sensitizing agents such as polyoxyethylene compounds, polyoxypropylene compounds and compounds which have quaternary ammonium groups may also be included.

Various compounds can be included in the photographic emulsions used in the invention with a view to preventing the occurrence of fogging during the manufacture, storage or photographic processing of the photosensitive material, or with a view to stabilizing photographic performance. Thus, many compounds which are known as antifogging agents or stabilizers, such as azoles, for example benzothiazolium salts, nitroindazoles, triazoles, benzotriazoles and benzimidazoles (especially nitro or halogen substituted derivatives); heterocyclic mercapto compounds, for example mercaptothiazoles, mercaptobenzothiazoles, mercaptobenzimidazoles, mercaptothiadiazoles, mercaptotetrazoles (especially 1-phenyl-5-mercaptotetrazole) and mercaptopyrimidines; heterocyclic mercapto compounds as described above but which have water solubilizing groups such as carboxyl groups and sulfo groups; thioketo compounds, for example oxazolinthione; azaindenes, for example tetraazaindenes (especially 4-hydroxy substituted (1,3,3a,7-tetraazaindenes); benzenethiosulfonic acids; and benzenesulfinic acid, can be used for this purpose.

The polymer latexes comprised of homopolymers or copolymers of alkyl acrylates, alkyl methacrylates, acrylic acid and glycidyl acrylate such as those disclosed, for example, in U.S. Pat. Nos. 3,411,911, 3,411,912, 3,142,568, 3,325,286 and 3,547,650, and JP-B No. 45-5331 can be included with a view to increasing the dimensional stability of the photographic material or with a view to improving film properties.

Poly(alkylene oxide) compounds can be used to increase the infectious development effect when the silver halide emulsions of the invention are used in lith type photosensitive materials for plate making purposes. For example, compounds such as those disclosed in the specifications of U.S. Pat. Nos. 2,400,532, 3,294,537 and 3,294,540, French Patent Nos. 1,491,805 and 1,596,673, JP-B No. 40-23466, JP-A No. 50-156423, JP-A No. 54-18726 and JP-A No. 56-151933 can be used. Preferred examples include condensates of poly(alkylene oxides) which are comprised of at least 10 units of an alkylene oxide which has from 2 to 4 carbon atoms, for example ethylene oxide, propylene-1,2-oxide or butylene-1,2-oxide, and preferably ethylene oxide, with compounds which have a least one active hydrogen atom, for example water, an aliphatic alcohol, a fatty acid, an organic amine or a hexitol derivative, and block polymers of two or more types of poly(alkylene oxide). That is to say, in practical terms, polyalkyleneglycol alkyl ethers, polyalkyleneglycol aryl ethers, polyalkyleneglycol alkyl aryl ethers, polyalkyleneglycol esters, polyalkyleneglycol fatty acid amides, polyalkyleneglycolamines, polyalkyleneglycol block copolymers and polyalkyleneglycol graft copolymers, for example, can be used as actual examples of these poly(alkylene oxide) compounds. The poly(alkylene oxide) compounds which can be used are of molecular weight from 300 to 15,000, and preferably of molecular weight from 600 to 8,000. The amount of these poly(alkylene oxide) compounds added is preferably from 10 mg to 3 grams per mol of silver halide. The addition can be made at any period during the manufacturing process.

The silver halide photographic emulsions of the invention can contain color couplers, for example, cyan, magenta and yellow couplers, and compounds in which couplers are dispersed.

That is to say, compounds which form colors by means of an oxidative coupling reaction with a primary aromatic amine developing agent (for example, a phenylenediamine derivative or an aminophenol derivative) during the color development process may be included. For example, 5-pyrazolone couplers, pyrazolobenzimidazole, cyanoacetylchroman couplers and open chain acylacetonitrile couplers can be used as magenta couplers, acylacetamido couplers (for example benzoylacetanilides and pivaloylacetanilides) can be used, for example, as yellow couplers, and naphthol couplers and phenol couplers, for example, can be used as cyan couplers. These couplers preferably have a high diffusivity, having hydrophobic groups, known as ballast groups, within the molecule. The couplers may be four-equivalent or two-equivalent with respect to silver halide. Furthermore, color couplers which have a color correcting effect, and couplers which release development inhibitors as development proceeds (so-called DIR couplers) can also be used.

Furthermore, non-color forming DIR coupling compounds of which the products of the coupling reaction are colorless and which release development inhibitors can be used as well as DIR couplers.

Water soluble dyes (for example, oxonol dues, hemioxonol dyes and merocyanine dyes) may be included in silver halide photographic emulsions of the invention as filter dyes, for anti-irradiation purposes or for other purposes.

Various surfactants can be included in photographic emulsions of the invention for various purposes, for example as coating promotors, for anti-static purposes, for improving slip properties, for emulsification and dispersion purposes, for the prevention of sticking and for improving photographic performance (for example, for accelerating development, increasing contrast or increasing sensitivity).

For example, use can be made of non-ionic surfactants, such as saponin (steroid based), alkylene oxide derivatives (for example, poly(ethylene glycol)), poly(ethylene glycol) alkyl ethers, glycidol derivatives, fatty acid esters of polyhydric alcohols and sugar alkyl esters; anionic surfactants such as alkylcarboxylates, alkylsulfonates, alkylbenzenesulfonates, and alkylsulfate esters; and cationic surfactants such as alkylamine salts, aliphatic and aromatic quaternary ammonium salts, and heterocyclic quaternary ammonium salts, for example pyridinium salts and imidazolium salts. Furthermore, fluorine containing surfactants are preferably included in cases where surfactants are used for antistatic purposes.

The known anti-color fading agents indicated below can be used conjointly when executing this invention, and color image stabilizers which can be used in the invention can be used individually, or two or more types may be used conjointly. Known anti-color fading agents include hydroquinone derivatives, gallic acid derivatives, p-alkoxyphenol derivatives, p-oxyphenol derivatives and bisphenols.

Inorganic or organic film hardening agents may be included in photographic emulsions of the invention. For example, chromium salts (for example, chrome alum, chromium acetate), aldehydes (for example, formaldehyde, glyoxal, glutaraldehyde), active vinyl compounds (for example, 1,3,5-triacryloyl-hexahydro-s-triazine, 1,3-vinylsulfonyl-2-propanol), and active halogen compounds (for example, 2,4-dichloro-6-hydroxy-s-triazine) can be used either individually or in combinations.

Photosensitive materials made using the invention may contain hydroquinone derivatives, aminophenol derivatives and gallic acid derivatives, for example, as anti-color fogging agents.

As well as gelatin, acylated gelatins such as phthalated gelatin and malonated gelatin, cellulose compounds such as hydroxyethylcellulose and carboxymethylcellulose; soluble starches such as dextrin; hydrophilic polymers such as poly(vinyl alcohol), polyvinylpyrrolidone, polyacrylamide and poly(styrenesulfonic acid) can be used as protective colloids, and plasticizers and latex polymers for providing dimensional stability, and matting agents, can be added to the silver halide photographic emulsions which are used in the invention. The finished emulsions are coated onto a suitable support, for example onto a baryta paper, resin coated paper, synthetic paper, triacetate film, poly(ethylene terephthalate) film or some other plastic film, or a glass plate.

The usual methods can be used for making the exposure for obtaining the photographic image. That is to say, any of the various known light sources, for example, natural light (daylight), tungsten lamps, fluorescent lamps, mercury lamps, xenon arc lamps, carbon arc lamps, xenon flash lights, lasers, LED and CRT can be used. The exposure time may, of course, be within the range from 1/1000th second to 1 second, the range normally used in a camera, and exposures shorter than 1/1000th seconds, for example exposures of from $10^{-4}$ to $10^{-6}$ seconds obtained using xenon strobe lights, can also be used, as can exposures of duration longer than 1 second. The spectral composition of the light used can also be adjusted, as required, using colored filters. Laser light can also be used for exposure purposes. Furthermore, exposures can also be made using the light emitted from phosphors which have been excited with electron beams, X-rays, $\gamma$-rays and $\alpha$-rays, for example.

The spectrally sensitizing dyes of the invention are used to sensitize silver halide emulsions for use in a variety of color and black and white photosensitive materials. The emulsions used may be, for example, color positive emulsions, color paper emulsions, color negative emulsions, color reversal emulsions (with and without the incorporation of couplers), emulsions for use in photosensitive materials which are used for making printing plates (for example, lith materials), emulsions which are used as photosensitive materials for use with cathode ray tube displays, emulsions which are used in silver diffusion transfer processes, emulsions which are used in color diffusion processes, emulsions which are used in dye transfer processes (imbitio transfer processes) (disclosed, for example, in U.S. Pat. No. 2,882,156), emulsions which are used in the silver dye-bleach method, emulsions which are used in materials for recording print-out images (for example, as disclosed in U.S. Pat. No. 2,369,449), emulsions which are used in direct print image type photosensitive materials (for example, as disclosed in U.S. Pat. No. 3,033,682, or emulsions which are used in heat developable color photosensitive materials.

Any of the known methods of processing and known processing baths, such as those disclosed, for example, in *Research Disclosure* No. 176, pages 28–30 (RD-17643) can be used for the photographic processing of photosensitive materials which have been made using the invention. This photographic processing may be either of the type in which a silver image is formed (black and white photographic processing) or of the type in which a dye image is formed (color photographic processing), depending on the intended purpose. The processing temperature is normally selected between 18° C. and 50° C., but temperatures below 18° C. and in excess of 50° C. may be used.

Actual examples in which the invention is used are described below. However, the invention is not limited by these illustrative examples.

EXAMPLE 1

A silver halide emulsion comprising pure cubic silver bromide was prepared and sulfur sensitized. The average diameter of the silver halide grains contained in the emulsion was 0.8 $\mu$, and each kilogram of emulsion contained 0.58 mol of silver halide.

One kilogram lots of the emulsion were weighed out into pots, sensitizing dyes represented by general formula [III] or general formula [IV], and then compounds represented by the general formula [I] or [II], were added as shown in tables 1-1 to 1-4, and the mixtures were agitated at 40° C. Moreover, 0.1 g/kg-emulsion of 4-hydroxy-6-methyl-1,3,3a,7-tetrazaindene, 0.1 g/kg-emulsion of 2,4-dichloro-6-hydroxy-1,3-5-triazine, sodium salt, and 0.1 g/kg-emulsion of sodium dodecylbenzenesulfonate were added sequentially, after which the mixtures were coated onto poly(ethylene terephthalate) film base and photographic photosensitive materials were obtained.

Each of the samples was exposed for 1 second to tungsten light (5400° K.) using a blue filter (a band pass filter transmitting light from 395 nm to 440 nm) and a yellow filter (a filter which transmitted light of wavelength longer than 500 nm).

After exposure, the samples were developed for 4 minutes at 20° C. using a development bath of which the composition is indicated below. The developed and processed films were subjected to density measurements and the photographic speeds using the blue filter (SB) and the yellow filter (Sy), and the fog levels, were obtained. The standard point of optical density at which the speeds were determined was fog +0.2.

| Composition of the Development Bath | |
|---|---|
| Water | 700 ml |
| Metol | 3.1 grams |
| Anhydrous sodium sulfite | 45 grams |
| Hydroquinone | 12 grams |
| Sodium carbonate (mono-hydrate) | 79 grams |
| Potassium bromide | 1.9 grams |
| Water to make up to | 1000 ml |

Twice the volume of water was added to prepare the development bath for use.

It is clear from tables 1-1 to 1-4 that the compounds represented by general formulae [I] and [II] of the invention had no sensitizing effect at all when used alone. However, when they were used conjointly with sensitizing dyes there was an improvement in respect of dye desensitization and there was an approximate matching increase in the spectrally sensitized photographic speed.

A sensitizing color effect is realized with so called M-band type dyes and J-band type dyes. Among the sensitizing dyes used in example 1, (III-9) is of the J-band type and the other three are of the M-band type. Furthermore, it can be concluded from the results obtained in example 1 that the effect can be realized with both cyanine dyes and merocyanine dyes.

TABLE 1-1

| Test No. | Compound [I] or [II] and Amount Used × $10^{-3}$ mol/kg · emulsion | | Sensitizing Dye [III] or [IV] and Amount Used × $10^{-4}$ mol/mol · emulsion | | Sy | SB | Fog | Remarks |
|---|---|---|---|---|---|---|---|---|
| 1 | — | | — | | — | 100 | 0.04 | Comp. Ex. |
| 2 | (21) | 0.22 | — | | — | 100 | 0.04 | Comp. Ex. |
| 3 | (21) | 0.66 | — | | — | 100 | 0.04 | Comp. Ex. |
| 4 | (21) | 2.2 | — | | — | 74 | 0.04 | Comp. Ex. |
| 5 | (21) | 6.6 | — | | — | 65 | 0.04 | Comp. Ex. |
| 6 | — | | (III-35) | 0.55 | 100 | 34 | 0.04 | Comp. Ex. |
| 7 | (21) | 0.22 | (III-35) | 0.55 | 147 | 50 | 0.04 | Invention |
| 8 | (21) | 0.66 | (III-35) | 0.55 | 155 | 53 | 0.04 | Invention |
| 9 | (21) | 2.2 | (III-35) | 0.55 | 170 | 58 | 0.04 | Invention |
| 10 | (21) | 6.6 | (III-35) | 0.55 | 166 | 57 | 0.04 | Invention |

TABLE 1-2

| Test No. | Compound [I] or [II] and Amount Used × $10^{-3}$ mol/kg · emulsion | | Sensitizing Dye [III] or [IV] and Amount Used × $10^{-4}$ mol/mol · emulsion | | Sy | SB | Fog | Remarks |
|---|---|---|---|---|---|---|---|---|
| 1 | — | | — | | — | 100 | 0.04 | Comp. Ex. |
| 2 | (1) | 0.022 | — | | — | 100 | 0.04 | Comp. Ex. |
| 3 | (1) | 0.22 | — | | — | 100 | 0.04 | Comp. Ex. |
| 4 | (1) | 2.2 | — | | — | 98 | 0.04 | Comp. Ex. |
| 5 | — | | (III-3) | 1.1 | 100 | 17 | 0.04 | Comp. Ex. |
| 6 | (1) | 0.022 | (III-9) | 1.1 | 186 | 35 | 0.04 | Invention |
| 7 | (1) | 0.22 | (III-9) | 1.1 | 331 | 60 | 0.04 | Invention |
| 8 | (1) | 2.2 | (III-9) | 1.1 | 200 | 47 | 0.04 | Invention |

TABLE 1-3

| Test No. | Compound [I] or [II] and Amount Used × $10^{-3}$ mol/kg · emulsion | | Sensitizing Dye [III] or [IV] and Amount Used × $10^{-4}$ mol/mol · emulsion | | Sy | SB | Fog | Remarks |
|---|---|---|---|---|---|---|---|---|
| 1 | — | | — | | — | 100 | 0.04 | Comp. Ex. |
| 2 | (2) | 0.022 | — | | — | 98 | 0.04 | Comp. Ex. |
| 3 | (2) | 0.22 | — | | — | 98 | 0.04 | Comp. Ex. |
| 4 | (2) | 2.2 | — | | — | 96 | 0.04 | Comp. Ex. |
| 5 | — | | (IV-12) | 0.22 | 100 | 28 | 0.05 | Comp. Ex. |
| 6 | (2) | 0.022 | (IV-12) | 0.22 | 145 | 41 | 0.05 | Invention |
| 7 | (2) | 0.22 | (IV-12) | 0.22 | 182 | 50 | 0.05 | Invention |
| 8 | (2) | 2.2 | (IV-12) | 0.22 | 178 | 57 | 0.05 | Invention |

TABLE 1-4

| Test No. | Compound [I] or [II] and Amount Used × $10^{-3}$ mol/kg · emulsion | | Sensitizing Dye [III] or [IV] and Amount Used × $10^{-4}$ mol/mol · emulsion | | Sy | SB | Fog | Remarks |
|---|---|---|---|---|---|---|---|---|
| 1 | — | | — | | — | 100 | 0.04 | Comp. Ex. |
| 2 | (8) | 0.022 | — | | — | 100 | 0.04 | Comp. Ex. |
| 3 | (8) | 0.22 | — | | — | 100 | 0.04 | Comp. Ex. |
| 4 | (8) | 2.2 | — | | — | 96 | 0.04 | Comp. Ex. |
| 5 | — | | (IV-7) | 0.55 | 100 | 20 | 0.04 | Comp. Ex. |
| 6 | (8) | 0.022 | (IV-7) | 0.55 | 178 | 36 | 0.04 | Invention |
| 7 | (8) | 0.22 | (IV-7) | 0.55 | 174 | 35 | 0.04 | Invention |
| 8 | (8) | 2.2 | (IV-7) | 0.55 | 162 | 32 | 0.04 | Invention |

EXAMPLE 2

A gold/sulfur sensitized silver halide emulsion comprised of 92 mol·% silver bromide and 8 mol·% silver iodide was prepared. The average diameter of the silver halide grains in this emulsion was 0.75 μ, and the emulsion contained 0.6 mol of silver halide per kilogram. One kilogram lots of the emulsion were weighed out into pots, sensitizing dyes represented by general formula [III] or general formula [IV] were added, and then compounds represented by the general formula [I] or [II] were added, as shown in table 2, and the mixtures were agitated at 40° C. Moreover, 0.1 g/kgμemulsion of 4-hydroxy-6-methyl-1,3,3a,7-tetrazaindene, 0.1 g/kg·emulsion of 2,4-dichloro-6-hydroxy-1,3-5-triazine, sodium salt, and 0.1 g/kg·emulsion of sodium dodecylbenzenesulfonate were added sequentially, after which the mixtures were coated onto poly(ethylene terephthalate) film base and photographic photosensitive materials were obtained.

These samples were exposed for 1/20th second to tungsten light (5400° K.) using a yellow filter the same as that used in example 1.

After exposure, the samples were developed for 7 minutes at 20° C. using a development bath of which the composition is indicated below. Moreover, after coating, film samples were left to stand for 3 months under conditions of 60% relative humidity, 25° C. and then these samples were exposed and developed and processed in the same way as before, and the changes in the speed and fog levels were measured.

| Composition of the Development Bath | |
|---|---|
| Water | 700 ml |
| Metol | 2 grams |
| Anhydrous sodium sulfite | 100 grams |
| Hydroquinone | 5 grams |
| Borax (penta-hydrate) | 1.5 grams |
| Water to make up to | 1000 ml |

It is clear from table 2 that the compounds represented by general formulae [I] and [II] of the invention contribute to sensitization when used conjointly with sensitizing dyes, and it can also be concluded that there is an improvement in desensitization in respect of ageing variations.

TABLE 2

| Test No. | Compound [I] or [II] and Amount Used × $10^{-3}$ mol/kg · emulsion | | Sensitizing Dye [III] or [IV] and Amount Used × $10^{-4}$ mol/kg · emulsion | | Immediately After Coating (A) Sy | Immediately After Coating (A) Fog | After Ageing 3 Months (B) Sy | After Ageing 3 Months (B) Fog | Change in Speed due to Ageing [(A)/(B)] × 100% | |
|---|---|---|---|---|---|---|---|---|---|---|
| 1 | — | | (III-4) | 2 | 630 | 0.05 | 460 | 0.06 | 73 | Comp. Ex. |
| 2 | (26) | 0.02 | (III-4) | 2 | 890 | 0.05 | 830 | 0.05 | 93 | Invention |
| 3 | (26) | 0.06 | (III-4) | 2 | 930 | 0.05 | 887 | 0.05 | 95 | Invention |
| 4 | (26) | 0.20 | (III-4) | 2 | 935 | 0.05 | 910 | 0.05 | 95 | Invention |
| 5 | — | | (IV-6) | 0.5 | 100 | 0.06 | 72 | 0.07 | 72 | Comp. Ex. |
| 6 | (44) | 0.02 | (IV-6) | 0.5 | 155 | 0.06 | 138 | 0.06 | 89 | Invention |
| 7 | (44) | 0.06 | (IV-6) | 0.5 | 162 | 0.06 | 151 | 0.06 | 93 | Invention |
| 8 | (44) | 0.20 | (IV-6) | 0.5 | 168 | 0.06 | 153 | 0.06 | 91 | Invention |
| 9 | — | | (III-10) | 2 | 1020 | 0.05 | 850 | 0.05 | 83 | Comp. Ex. |
| 10 | (1) | 0.02 | (III-10) | 2 | 1380 | 0.05 | 1220 | 0.05 | 88 | Invention |
| 11 | (1) | 0.06 | (III-10) | 2 | 1545 | 0.05 | 1460 | 0.05 | 94 | Invention |
| 12 | (1) | 0.20 | (III-10) | 2 | 1580 | 0.05 | 1485 | 0.05 | 94 | Invention |
| 13 | — | | (III-21) | 2 | 296 | 0.06 | 230 | 0.06 | 78 | Comp. Ex. |
| 14 | (25) | 0.02 | (III-21) | 2 | 364 | 0.06 | 324 | 0.06 | 89 | Invention |
| 15 | (25) | 0.06 | (III-21) | 2 | 400 | 0.06 | 365 | 0.06 | 91 | Invention |
| 16 | (25) | 0.20 | (III-21) | 2 | 419 | 0.06 | 391 | 0.06 | 93 | Invention |

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion including a spectrally sensitizing dye and at least one compound represented by general formula (I) as shown below:

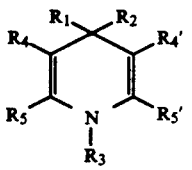

General Formula (I)

wherein $R_1$ and $R_2$ each represents a hydrogen atom, an ethyl group or a phenyl group;

$R_3$ represents a hydrogen atom, a methyl group or a phenyl group;

$R_4$ and $R_4'$ each represents an alkoxycarbonyl group, a cyano group, an acetyl group or a carbamoyl group; and $R_5$ and $R_5'$ each represents a methyl group or a phenyl group, wherein the methyl group or phenyl group can be substituted with an adsorbable group represented by $(L_{16})_r$-Het, wherein $L_{16}$ represents a divalent linking group comprising an atom or group of atoms which includes at least one carbon atom, nitrogen atom or oxygen atom; Het represents a five-, six- or seven-membered heterocyclic ring which contains at least one nitrogen atom and which may contain hetero atoms other than nitrogen; and r is 0, 1 or 2.

2. The silver halide photographic emulsion of claim 1 wherein the spectrally sensitizing dye is a compound represented by general formula (III) or general formula (IV) as shown below:

General Formula (III)

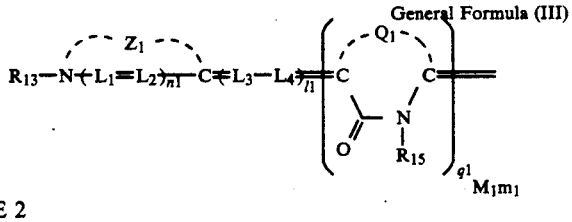

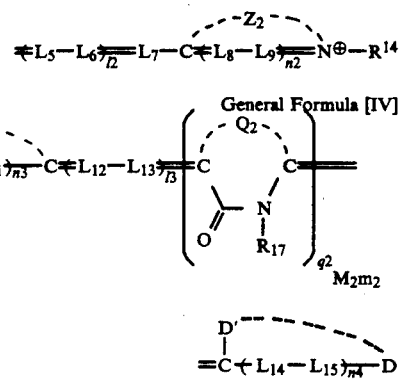

General Formula [IV]

wherein $R_{13}$, $R_{14}$ and $R_{16}$ represent alkyl groups; $R_{15}$ and $R_{17}$ represent alkyl groups, aryl groups or heterocyclic groups;

$Z_1$, $Z_2$ and $Z_3$ represent groups of atoms which are required to form five or six membered nitrogen containing heterocyclic rings;

$Q_1$ and $Q_2$ represent groups of atoms which are required to form five or six membered nitrogen containing heterocyclic rings;

D and D' represent groups of atoms which are required to form cyclic or non-cyclic acidic nuclei;

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$ and $L_{15}$ represent methine groups;

$n_1$, $n_2$, $n_3$ and $n_4$ are 0 or 1;

$l_1$, $l_2$ and $l_3$ represent 0, 1, 2 or 3;

$q_1$ and $q_2$ represent 0 or 1;

$M_1$ and $M_2$ represent charge balancing counter ions; and $m_1$ and $m_2$ are the numbers of value at least zero which are required to balance the charge.

3. The silver halide photographic emulsion of claim 1 wherein $R_1$, $R_2$ and $R_3$ each represents a hydrogen atom;

$R_4$ and $R_4'$ each represents an alkoxycarbonyl group; and $R_5$ and $R_5'$ each represents a methyl group.

4. A silver halide photographic emulsion including a spectrally sensitizing dye and at least one compound represented by general formula (I) as shown below:

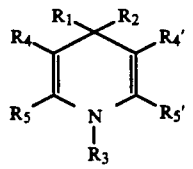

(I)

wherein $R_1$ and $R_2$ each represents a hydrogen atom, an ethyl group or a phenyl group;

$R_3$ represents a hydrogen atom, a methyl group or a phenyl group;

$R_4$ and $R_4'$ each represents an alkoxycarbonyl group, a cyano group, an acetyl group or a carbamoyl group; and $R_5$ and $R_5'$ each represents a methyl group or a phenyl group, provided that at least one of $R_4$, $R_4'$, $R_5$ and $R_5'$ is a substituted group which contains as a substituent a group selected from the group consisting of adsorbable groups represented by the formula:

$(L_{16})_r$-Het wherein $L_{16}$ represents a divalent linking group comprising an atom or group of atoms which includes at least one carbon atom, nitrogen atom or oxygen atom; Het represents a five-, six- or seven-membered heterocyclic ring which contains at least one nitrogen atom and which may contain hetero atoms other than nitrogen; and r is 0, 1 or 2.

* * * * *